US010807757B2

(12) United States Patent
Henderson et al.

(10) Patent No.: US 10,807,757 B2
(45) Date of Patent: Oct. 20, 2020

(54) METHOD AND APPARATUS FOR DISPENSING PRESSURE SENSITIVE ADHESIVE LABELS ONTO A SUBSTRATE

(71) Applicant: Avery Dennison Corporation, Glendale, CA (US)

(72) Inventors: Kevin O. Henderson, Willoughby Hills, OH (US); Victor P. Holbert, Newbury, OH (US)

(73) Assignee: Avery Dennison Corporation, Glendale, CA (US)

( * ) Notice: Subject to any disclaimer, the term of this patent is extended or adjusted under 35 U.S.C. 154(b) by 1171 days.

(21) Appl. No.: 14/262,029

(22) Filed: Apr. 25, 2014

(65) Prior Publication Data

US 2014/0318700 A1 Oct. 30, 2014

Related U.S. Application Data

(60) Provisional application No. 61/816,187, filed on Apr. 26, 2013.

(51) Int. Cl.
*B65C 9/18* (2006.01)
*B65C 9/00* (2006.01)

(52) U.S. Cl.
CPC ..... *B65C 9/1865* (2013.01); *B65C 9/0006* (2013.01); *B65C 9/1869* (2013.01); *Y10T 156/1744* (2015.01); *Y10T 156/1994* (2015.01)

(58) Field of Classification Search
None
See application file for complete search history.

(56) References Cited

U.S. PATENT DOCUMENTS

| | | | |
|---|---|---|---|
| 2,679,505 | A | 5/1954 | Weinberg |
| 3,985,826 | A | 10/1976 | Futamura |
| 4,347,094 | A | 8/1982 | Watanabe |
| 4,479,839 | A | 10/1984 | Tasma |
| 4,950,518 | A | 8/1990 | Walliser |

(Continued)

FOREIGN PATENT DOCUMENTS

| | | |
|---|---|---|
| CN | 2457041 | 10/2001 |
| CN | 102030123 | 4/2011 |

(Continued)

OTHER PUBLICATIONS

Machine translation of FR 2365487 (Year: 1978).*

(Continued)

*Primary Examiner* — Barbara J Musser

(57) ABSTRACT

A labeling apparatus comprises a separation member configured to promote detachment of an adhesive label from liner web. Adhesive labels are fed to the separation member such that a surface of the facestock contacts the separation member. The separation member has a surface exhibiting a tack such that the tack force between the facestock and the separation member is greater than the release force between the release liner and the adhesive layer of the labels. The labels become associated with the separation member, and the label is applied to a surface of a substrate by contacting the exposed adhesive layer with a surface of a substrate, which causes the adhesive label to detach from the separation member.

12 Claims, 3 Drawing Sheets

(56) References Cited

U.S. PATENT DOCUMENTS

| | | | | |
|---|---|---|---|---|
| 5,178,717 | A * | 1/1993 | Rodriguez | B65H 35/0033 156/523 |
| 5,201,976 | A | 4/1993 | Eastin | |
| 5,405,482 | A | 4/1995 | Morrissette et al. | |
| 5,458,938 | A | 10/1995 | Nygard et al. | |
| 5,549,783 | A | 8/1996 | Schroeder et al. | |
| 5,708,083 | A | 1/1998 | Kawamura et al. | |
| 5,756,173 | A | 5/1998 | Tung et al. | |
| 5,776,289 | A | 7/1998 | Steidinger | |
| 5,824,183 | A | 10/1998 | Crankshaw | |
| 5,879,507 | A | 3/1999 | Schroeder et al. | |
| 6,033,725 | A | 3/2000 | Moeller et al. | |
| 6,110,552 | A | 8/2000 | Casey et al. | |
| 6,110,554 | A | 8/2000 | Moeller et al. | |
| 6,242,510 | B1 * | 6/2001 | Killey | B32B 37/12 156/307.4 |
| 6,403,190 | B1 | 6/2002 | Casey et al. | |
| 6,568,451 | B1 | 5/2003 | Korthauer | |
| 6,812,292 | B2 | 11/2004 | Terano et al. | |
| 7,201,202 | B2 | 4/2007 | Ensign, Jr. | |
| 7,270,874 | B2 | 9/2007 | Dalgleish | |
| 7,399,509 | B2 | 7/2008 | Virtanen | |
| 7,473,454 | B2 | 1/2009 | Virtanen | |
| 7,802,602 | B2 | 9/2010 | Siedlaczek | |
| 7,954,531 | B2 | 6/2011 | Yuyama et al. | |
| 8,017,207 | B2 | 9/2011 | Hacikyan | |
| 9,162,820 | B2 | 10/2015 | Hanisch et al. | |
| 9,340,313 | B2 | 5/2016 | Till | |
| 2002/0015896 | A1 * | 2/2002 | Ohtaki | G03H 1/0248 430/1 |
| 2002/0060223 | A1 * | 5/2002 | O'Brien | B65C 9/0006 221/73 |
| 2005/0131154 | A1 | 6/2005 | Cai et al. | |
| 2005/0142319 | A1 | 6/2005 | Virtanen | |
| 2007/0039684 | A1 | 2/2007 | Nedblake | |
| 2008/0113150 | A1 | 3/2008 | Lee | |
| 2009/0017241 | A1 | 1/2009 | Sakuma et al. | |
| 2009/0145558 | A1 | 6/2009 | Saluz | |
| 2009/0188613 | A1 | 7/2009 | Fearn | |
| 2010/0069852 | A1 * | 3/2010 | Kelley | A61F 2/2436 604/264 |
| 2012/0082816 | A1 | 4/2012 | Wada et al. | |
| 2012/0082817 | A1 | 4/2012 | Wada et al. | |
| 2012/0082818 | A1 | 4/2012 | Wada et al. | |
| 2013/0022797 | A1 * | 1/2013 | Lorence | B32B 27/32 428/201 |
| 2013/0126100 | A1 * | 5/2013 | Fujita | B65C 9/0006 156/719 |
| 2013/0175289 | A1 | 7/2013 | Sternberg | |
| 2013/0340946 | A1 * | 12/2013 | Frank | B65C 9/1869 156/540 |
| 2013/0341164 | A1 | 12/2013 | Frank et al. | |

FOREIGN PATENT DOCUMENTS

| | | | | |
|---|---|---|---|---|
| CN | 102417059 | | 8/2013 | |
| DE | 202006011787 | | 9/2006 | |
| EP | 0031383 | | 7/1981 | |
| EP | 0252739 | | 1/1988 | |
| EP | 0876960 | | 11/1998 | |
| EP | 1072663 | | 1/2001 | |
| EP | 2646240 | | 6/2012 | |
| EP | 2488417 | | 8/2012 | |
| EP | 2679506 | | 1/2014 | |
| FR | 2365487 | A1 * | 4/1978 | B65C 9/1865 |
| GB | 2464218 | | 4/2010 | |
| GB | 2516237 | | 1/2015 | |
| JP | 11-323280 | | 11/1999 | |
| JP | 2006-248565 | | 9/2006 | |
| JP | 2011-037491 | | 2/2011 | |
| JP | 2011-088669 | | 5/2011 | |
| WO | 02/055295 | | 7/2002 | |
| WO | WO2011045587 | | 4/2011 | |
| WO | 2012/009755 | | 1/2012 | |
| WO | 2012/072889 | | 6/2012 | |
| WO | 2012/127121 | | 9/2012 | |
| WO | 2013/001194 | | 1/2013 | |
| WO | 2013/011193 | | 1/2013 | |
| WO | 2013/140035 | | 9/2013 | |
| WO | 2016/021446 | | 2/2016 | |

OTHER PUBLICATIONS

Polysilane, wikipedia. (Year: 2020).*

Silicone, wikipedia (Year: 2020).*

International Preliminary Report on Patentability issued in corresponding IA No. PCT/US2014/061502 dated May 6, 2016.

Qin, Dong, et al., "Soft lithography for micro- and nanoscale patterning," Nature Protocols, vol. 5, No. 3, pp. 491-502, published online Feb. 18, 2010.

Thanh-Vinh, N., et al., "Micro suction cup array for wet-dry adhesion," MEMS 2011, Cancum, Mexico, Jan. 23-27, 2011, pp. 284-287.

"Create arrays of micro-scale shapes, lenses, patterns, and structures more quickly and at lower cost than with conventional photolithography, for shortened development time," Tech of the Week, yet2.com, Oct. 13, 2013.

International Preliminary Report on Patentability issued in corresponding IA No. PCT/US2014/035462 dated Oct. 27, 2015.

International Search Report and Written Opinion issued in corresponding IA No. PCT/US2014/035462 dated Sep. 16, 2014.

International Search Report and Written Opinion issued in corresponding IA No. PCT/US2014/061502 dated Feb. 12, 2015.

* cited by examiner

METHOD AND APPARATUS FOR DISPENSING PRESSURE SENSITIVE ADHESIVE LABELS ONTO A SUBSTRATE

CROSS-REFERENCE TO RELATED APPLICATION

The present application claims the benefit of U.S. Provisional Application No. 61/816,187 filed Apr. 26, 2013, which is incorporated herein by reference in its entirety.

BACKGROUND

Pressure-sensitive adhesive (PSA) constructions such as labels, tapes, decals, etc., are commonly used to apply a particular facestock having a specific nature of printing to an object or article. PSA label constructions typically comprise a release liner, a PSA layer disposed onto the liner, and a facestock laminated onto the PSA layer. This lamination may be formed by first coating or laminating the PSA to the liner, then laminating the facestock onto the PSA-coated liner. Alternatively, the label can be formed by coating or laminating the PSA to the facestock, then laminating the PSA-coated facestock onto the liner. The facestock is characteristically made from a web or sheet of paper, cardboard or plastic, which is printed on with information or other indicia either before or after it is laminated to the PSA and liner. A plastic facestock can be a single layer or multiple layers formed either by lamination or coextrusion.

In a typical process of "converting" the facestock/PSA/liner laminate, the facestock is printed on the exposed facestock surface, die-cut down to the liner surface to outline the label shape, and the waste material between the labels (matrix) is stripped out. The PSA label facestock and adhesive are then adhered to a substrate surface by separating the label from the liner and causing the PSA layer of the label to come into contact with and bond to the substrate surface with the PSA layer providing the bonding force (as measured by a peel test). In the most popular labeling process, the label is separated from the liner by bending the liner back over a peel-plate, whereupon the label is sufficiently stiff to cause the label to continue on a straight path toward the desired substrate surface overcoming the release force between the label adhesive and the release liner. Peel-plate dispensing is generally done at room temperature.

In the manufacture and production of PSA constructions, a substantial amount of the overall cost involved is attributed to the material costs for the different material layers, e.g., the PSA and the facestock, be it paper, cardboard, plastic, etc. This is one constraint on the selection of the type and thickness of the various layers. The layer thicknesses and layer materials for such conventional PSA constructions must also be selected to provide desired properties of convertibility, e.g., by conventional converting techniques such as by die-cutting and matrix-stripping; dispensability, e.g., by conventional dispensing equipment such as by peel-plate; and conformability, e.g., enabling the applied label to adhere to an irregular or deformable substrate surface without becoming detached or damaged.

The stiffness of a PSA construction will have an impact on its convertibility and dispensability. The stiffness of a label of a given material decreases as the label is made thinner. As a rule of thumb, the convertibility and dispensability of the construction improves as the construction stiffness is increased. However, the conformability of a PSA construction is known to decrease as the construction stiffness is increased. Thus, the objective stiffness for a PSA construction is a compromise between convertibility/dispensability, conformability, and cost. If the stiffness is too low, the label can go around the peel-plate with the liner.

SUMMARY

The present technology provides an apparatus and method for dispensing pressure sensitive adhesives onto a substrate. In one aspect, the present technology provides an apparatus and method that allows for effective dispensing of low stiffness labels onto a substrate. The apparatus provides an alternative to conventional peel plate dispensing systems and methods.

In one aspect, the present invention provides an apparatus for dispensing adhesive labels from a liner web onto a substrate comprising: a feed roll for housing a roll of label material comprising a plurality of adhesive labels disposed on a release liner; the adhesive labels comprising a facestock having an upper surface and a lower surface, and an adhesive layer disposed adjacent the lower surface of the facestock and in contact with the release liner; a separation member for removing the adhesive labels from the release liner; a nip member disposed adjacent the separation member; and a take-up roll for winding the release liner; wherein the label material is oriented such that the upper surface of the facestock contacts the separation member as the label material is fed through the apparatus, and the separation member has a tackified surface providing a tack force between the upper surface of the facestock and the surface of the separation member that is greater than the release force between the adhesive layer and the release liner, and the tackified surface promotes separation of the adhesive labels from the release liner as the upper surface of the facestock contacts the separation member.

In another aspect, the present invention provides a method of applying a pressure sensitive adhesive label to a surface of a substrate comprising: providing a continuous roll of label material comprising a plurality of adhesive labels releasable attached to a release liner web, the adhesive labels comprising a facestock having an upper surface and a lower surface, and an adhesive layer disposed adjacent the lower surface of the facestock and in contact with the release liner; feeding the label material through a labeling apparatus such that the upper surface of the facestock engages a separation member, where the separation member has a tackified surface providing a tack force between the surface of the separation member and the facestock that is greater than the release force between the release liner and the adhesive layer, and the adhesive label detaches from the release liner and associates with the separation member; and contacting a surface of a substrate with a leading edge of the adhesive layer of the adhesive label associated with the separation member, where the tack force between the adhesive layer and the substrate is greater than the tack force between the upper surface of the facestock and the surface of the separation member, and the adhesive label detaches from the separation member and is applied to the surface of the substrate.

The drawings are for purposes of illustrating aspects and embodiments of the technology and are not intended to limit the invention to those specific embodiments. Unless otherwise specified, the drawings are not drawn to scale. Aspects of the technology can be further understood with reference to the drawings and the following description.

DETAILED DESCRIPTION

The present technology provides an apparatus for dispensing a pressure sensitive adhesive onto a substrate. The dispensing apparatus provides an alternative apparatus to conventional peel plate machines. The dispensing apparatus can allow for dispensing labels having a relatively low stiffness onto a substrate.

As used in this patent application, "separation" refers to removal of the label from the liner, "application" refers to adhesion of the label to the substrate surface, and "dispensing" or "dispensability" refers to the combined steps of separation and application. "Peel-plate dispensing" as used herein, denotes the use of a peel-plate, sharp edge, or other similar device having a small radius of curvature, in the separation of liner from label.

Figure 1:
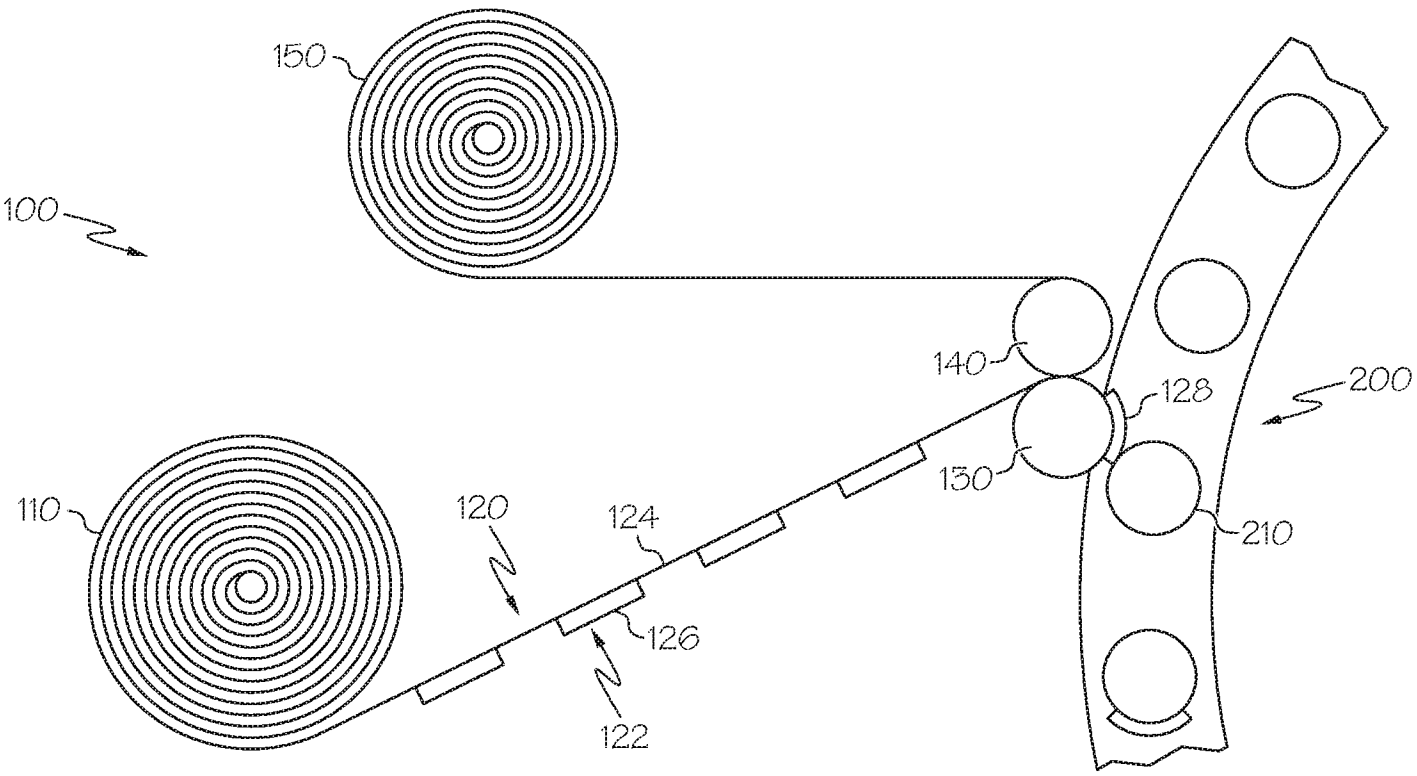
FIG. 1 is a schematic of a label dispensing apparatus in accordance with an embodiment of the technology.

FIG. 1 illustrates an embodiment of a label dispensing apparatus 100 in accordance with one embodiment of the present technology. The dispensing apparatus 100 includes a feed roll 110 having a roll of label stock 120 wound on the roll. The label stock 120 comprises pressure sensitive adhesive labels 122 disposed on a release liner web 124. The pressure sensitive adhesive labels 122 comprise a facestock with an upper surface 126 and an adhesive face 128 adjacent the liner web.

The label stock is fed toward a label separation member 130 and a nip member 140. The upper surface 126 of the labels 122 engages separation member 130. The separation member has a tackified surface such that the tack force between the separation member 130 and the upper surface 126 of the labels 122 is greater than release force between the adhesive surface 128 of the label 122 and the release liner 124. This results in the label 122 separating from the release liner 124 when the upper surface of the label engages the separation roller. When the liner and the adhesive label separate, the release liner is drawn around the nip member 140 and toward a liner take-up roller 150.

When the labels contact the separation member, the labels detach from the liner and become associated with the separation member 130. The labels 122 remain associated with the separation member 130 until the adhesive surface 128 of the label engages a surface of a target substrate where the tack force between the adhesive's surface and the substrate's surface is greater than the tack force between the surface of the separation roller and the upper surface 126 of the label. When this occurs, the upper surface 126 separates from the separation roller, and the label is applied to a surface of the substrate.

For example, in FIG. 1, the label dispensing apparatus is shown in the environment of a container labeling system. The labeling system includes a conveyor 200 for conveying containers 210 to be labeled. The labels 122 are separated from the liner 124 and become associated with the surface of the separation member 130. The separation member 130 rotates and carries the label 122 such that the leading edge of the adhesive surface 128 of label 122 engages a surface of a container 210. The tack force between the adhesive surface 128 and the surface of container 210 is greater than the tack force between the upper surface 126 and the surface of the separation member 130. When the adhesive layer contacts the surface of the container 210, the label detaches from the separation member 130 and is applied to the container 210. The system can be configured such that the container can be made to rotate as the label is applied to the container by the separation member.

Figure 2:
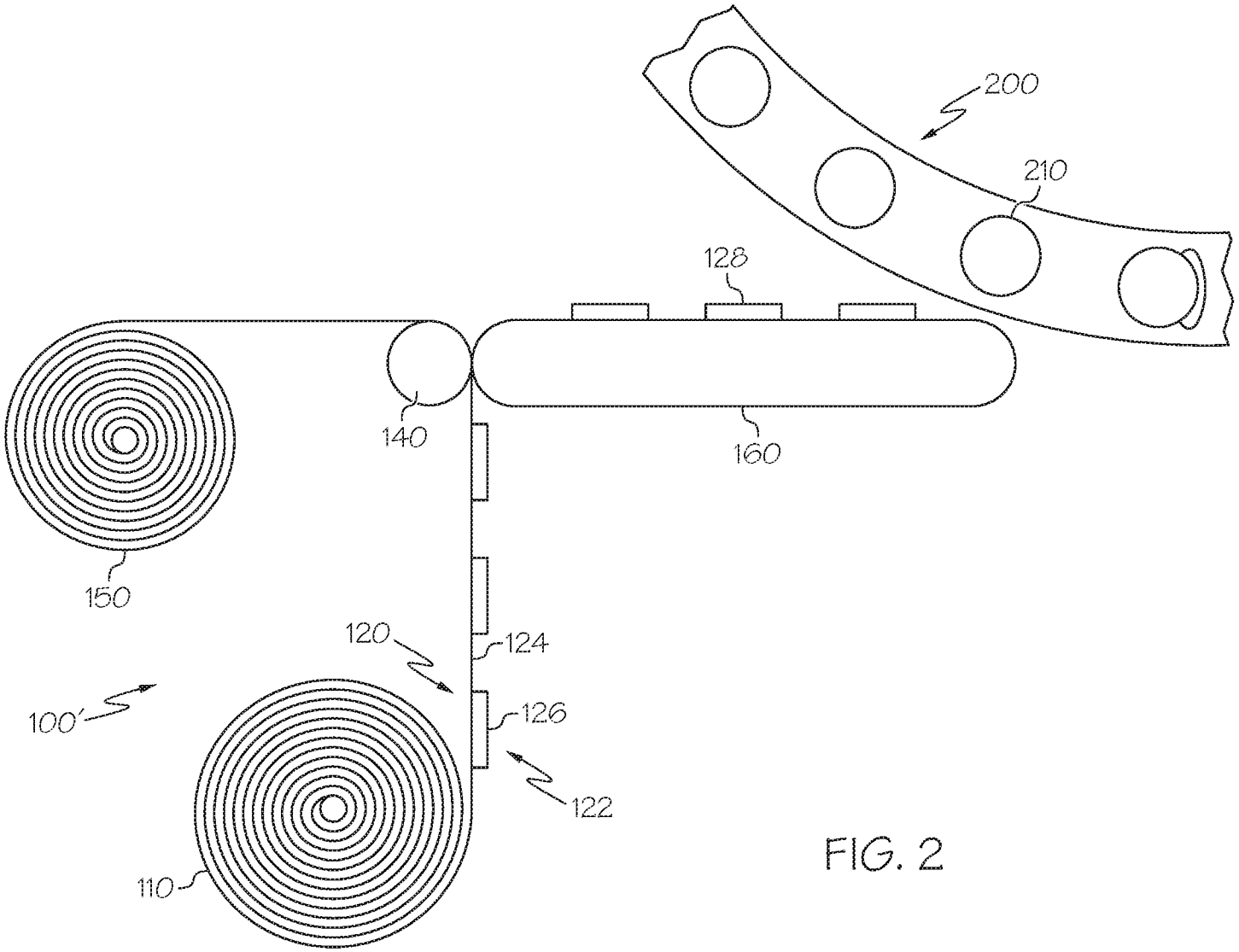
FIG. 2 is a schematic of a label dispensing apparatus in accordance with another embodiment of the technology.

The separation member can be provided by any suitable structure to carry the adhesive labels upon separation of the label from the liner web. As shown in FIG. 1, the separation member can comprise a roller. FIG. 2 illustrates another embodiment of a dispensing apparatus 100' that comprises a separation member 160. The separation member 160 is provided by a belt. The belt can be formed from any suitable material to support and carry the adhesive labels after they are separated from the liner web. The surface of the belt is configured such that the tack force between the print face of the adhesive label and the belt is greater than the release force between the adhesive and the release liner. The separation member 160 conveys the adhesive labels toward an appropriate location for attaching the label to the container. The tack force between the print face of the label and the surface of the belt is less than the tack for between the adhesive and the target substrate such that the labels can be separated from the separation member and attached to a target substrate (e.g., a container).

The apparatus can be provided as part of an automated system for continuously feeding the label stock material to the separation member. The rollers, e.g., take-up roller 150 or feed roller 110 can be driven by a motor to cause the label stock to be fed to the separation member.

Figure 3:
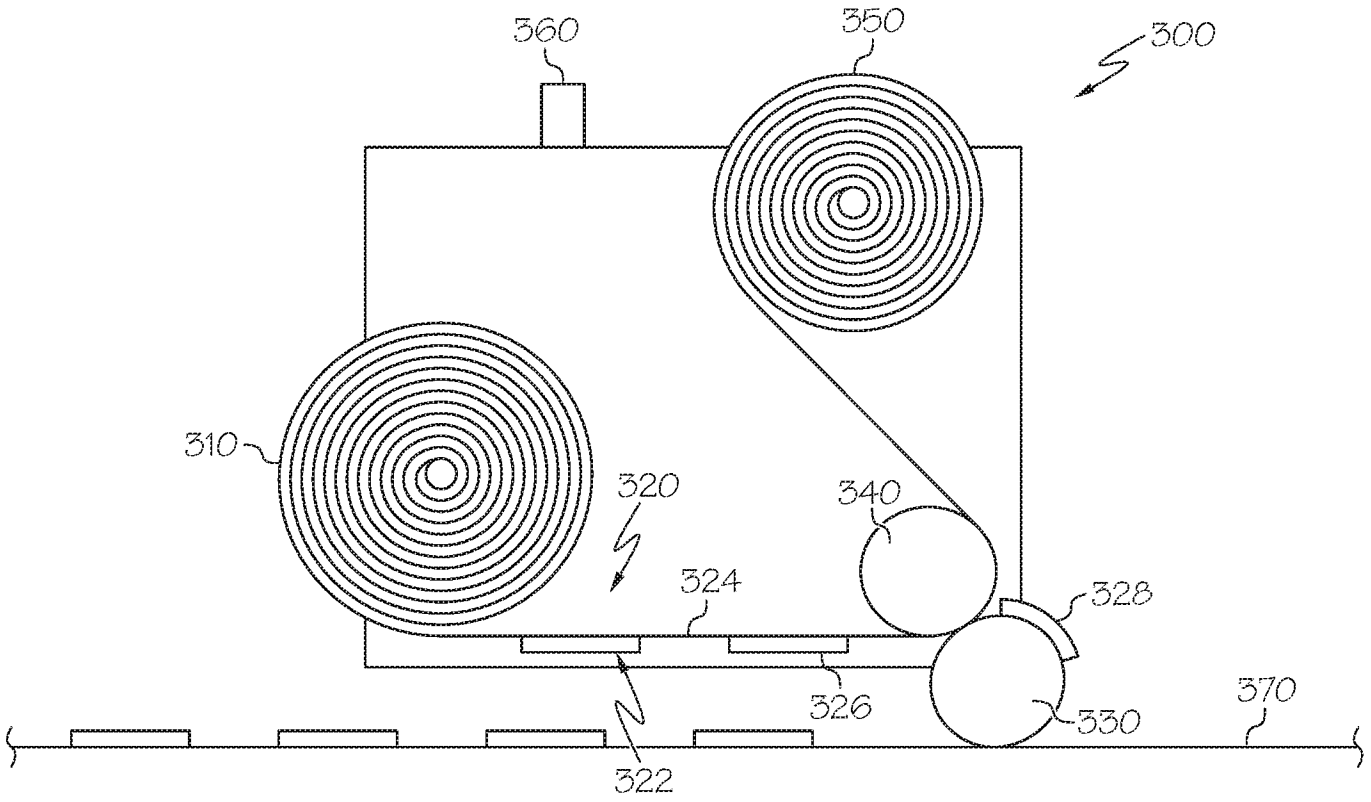
FIG. 3 is a schematic of a label dispensing apparatus in accordance with still another embodiment of the technology.

In another embodiment, the dispensing apparatus can be provided as a manual dispenser. FIG. 3 illustrates an embodiment of a manual dispenser 300. The dispensing apparatus 300 includes a feed roll 310 having a roll of label stock 320 wound on the roll. The label stock 320 comprises pressure sensitive adhesive labels 322 disposed on a release liner web 324. The pressure sensitive adhesive labels 322 comprise an upper surface 326 and an adhesive face 328 adjacent the liner web. The adhesive labels are wound around a nip member 330, and the liner is wound around a take-up roller 350. The dispenser includes a separation member 330 adjacent the nip member 340. The dispenser can further include a handle 360 or other member to hold and guide the dispenser. The adhesive labels can be dispensed by contacting the separation member with a surface of a target substrate 370 and moving the apparatus in a direction that feeds the liner and the labels toward the separation member. The separation member 330 turns as the apparatus is moved forward, and the label web is unwound from the feed roll 310 and fed toward the separation member. As the label web is fed through the apparatus, the upper surface 326 of the adhesive labels contacts the surface of separation member 330. The surface of separation member 330 is configured such that the tack force between the surface of separation member 330 and the upper surface of the adhesive label is greater than the release force between the adhesive surface 328 and the liner web 324. As the apparatus is moved forward along the surface of substrate 370, the adhesive surface 328 of the label 322 is brought into contact with the surface of substrate 370. The tack force between the adhesive surface 328 and the surface of the target substrate is greater than the tack force between the separation member 330 and the upper surface 326 of the adhesive label such that the label detaches from the separation member as the adhesive surface 328 comes in contact with the surface of the target substrate.

While not illustrated in FIG. 3, the separation member and the take-up roller can be mechanically connected such that the take-up roller turns when the separation member is moved or turned.

The separation member can be formed from any suitable material for a particular purpose or intended application included a metal, a plastic or other polymeric material, a rubber, etc. The separation member is provided such that the surface of the separation member has a sufficient tackiness to promote separation of the adhesive label from the liner when the upper surface of the adhesive contacts the surface of the separation member. In one embodiment, the separation member can be formed from a material exhibiting a desired tackiness to promote separation of the adhesive from the liner. In another embodiment, the surface of the separation member comprises a suitable coating to provide the separation member with a surface having a sufficient tackiness for promoting separation of the label from the release liner. Examples of suitable materials for coating the surface of the separation member include, but are not limited to, thermoplastic elastomers such as urethanes, polyolefins, polyesters, styrenic block copolymers, nylons, etc., silicone adhesives, silicone gels, etc.; acrylics; thermoplastic vulcanizates, etc. In one embodiment, the separation roll comprises a urethane coating disposed on the surface of the roll. Urethane materials are particularly suitable because such coatings generally do not lose their tack over time. This allows a separation roll coated with such material to be reused even after subsequent cleanings of the roll. Other materials suitable for coating the separation roll include, but are not limited to, styrenic block copolymer materials such as styrene-isoprene-styrene (SIS) materials, styrene-ethylene-butylene-styrene (SEBS) materials, etc. Examples of suitable styrenic block polymers for coating the separation member include, but are not limited, polymers sold under the trade name KRATON. Examples of suitable thermoplastic vulcanizate materials include, but are not limited to, polyolefin/rubber blends such as polypropylene/crosslinked EPDM rubber. An example of a suitable thermoplastic vulcanizate is material sold under the trade name SANTOPRENE. While discussed with respect to coating a separation member, it will be appreciated that the materials could also be employed to form or otherwise construct the separation member.

The separation member can also be made from a soft polymer or organic material textured by photolithography or soft lithography. The texture can be raised bumps or lamellae that produce enough friction to separate a label from a release liner. Alternatively, the surface may include depressions shaped like miniature suction cups or small pores. In these types of designs, the void(s) in the surface creates enough Van der Waals forces with the label such that the label will attach to the textured surface in the same manner as if a light adhesive were used.

One material used to make soft, textured surfaces is poly(dimethylsilane) or PDMS. However, any elastomer with a low shear modulus and low Young's modulus may be suitable for manufacturing such surfaces. Typical shear modulus values are <0.25 MPa with a Young's modulus <0.50 MPa. The patterning technique can include, but is not limited to, micro-contact printing, replica molding, micro-transfer molding, micro-molding in capillary, solvent-assisted micro-molding, phase-shifting edge lithography, nano-transfer printing, decal transfer lithography, nanoskiving, and dip-pen nano-lithography.

When a coating is employed to provide the tackified surface of the separation member, it is desirable that the coating not leave a residue on the upper surface of the adhesive label during the transfer process.

The nip member can be provided by any suitable structure or device to provide a contact point to force the upper surface of the label into contact with the surface of the separation member. When this occurs, the liner and the label are separated and directed in divergent paths. Non-limiting examples of suitable apparatus for the nip member include a nip roll, a plate, a brush, a sponge, a wiper blade, etc.

The label constructions useful with the present technology are generally not limited and can comprise a facestock, a release liner, and an adhesive layer between the facestock and the liner. The facestock that is used in the label constructions may comprise any of a variety of materials known to those skilled in the art to be suitable as a facestock material. For example, the facestock may be comprised of such materials as paper (e.g., kraft, bond, offset, litho, and sulfite paper) with or without sizing, or polymeric materials suitable for facestock use such as polyolefins, polyesters, polyamides, etc. In one embodiment, the requirement for the facestock material is that it be capable of forming some degree of adhesive bond to an adhesive layer. In one embodiment, the facestock comprises a polymeric film that can form the desired bond and is capable of being printed. In yet another embodiment, the polymeric film material is one that, when combined with the adhesive layer, provides a sufficiently self-supporting construction to facilitate label dispensing (label separation and application). The surfaces of the facestock material can be surface treated, such as, for example, corona treated, flame treated, or top coat treated to improve performance in various areas such as printability, adhesion to the adhesive layer in contact with the facestock, etc. In one embodiment, the polymer film material is chosen to provide the label construction with one or more of the desired properties such as printability, die-cuttability, matrix-strippability, dispensability, etc.

The facestock can be a monolayer polymeric film facestock or it can comprise more than one polymer film layer, some of which may be separated by an internal adhesive layer. The thicknesses of each of the layers may be varied. Multilayer film facestocks may be prepared by techniques well known to those skilled in the art such as by laminating two or more preformed polymeric films (and, optionally an adhesive layer) together, or by the coextrusion of several polymeric films and, optionally, an adhesive layer. The multilayer facestocks can be prepared also by sequential coating and formation of individual layers, triple die coating, extrusion coating of multiple layers onto an adhesive layer, etc.

The label constructions also include an adhesive layer having an upper surface and a lower surface wherein the upper surface of the adhesive layer is adhesively joined or adhered to the lower surface of the facestock. In some embodiments, as noted above, the constructions also contain an interior adhesive that can function as a lamination adhesive when laminating preformed polymeric films together to form a facestock. The internal adhesives can be a heat-activated adhesives, hot melt adhesives, or pressure sensitive adhesives (PSA). In one embodiment, the external (adhered to the facestock) adhesive is preferably a PSA. Adhesives that are tacky at any temperature up to about 160° C. (about 320° F.) are particularly useful. PSAs that are tacky at ambient temperatures are particularly useful in the adhesive constructions of the present invention. Ambient temperatures include room temperature and can range from 5 to 80° C., 10 to 70° C., or 15 to 60° C.

The adhesives can generally be classified into the following categories: random copolymer adhesives such as those based upon acrylate and/or methacrylate copolymers, alpha-olefin copolymers, silicone copolymers, chloroprene/acrylonitrile copolymers, and the like; and block copolymer adhesives including those based upon linear block copolymers (i.e., A-B and A-B-A type), branched block copolymers, star block copolymers, grafted or radial block copolymers, etc., and Natural and synthetic rubber adhesives. In one embodiment the adhesive of the adhesive layer is an emulsion acrylic-based pressure sensitive adhesive.

A description of useful pressure-sensitive adhesives may be found in Encyclopedia of Polymer Science and Engineering, Vol. 13. Wiley-Interscience Publishers (New York, 1988). Additional description of useful pressure-sensitive adhesives may be found in Encyclopedia of Polymer Science and Technology, Vol. 1, Interscience Publishers (New York, 1964).

The facestock can have a thickness as desired for a particular purpose or intended application. In one embodiment, the facestock has a thickness of from about 0.25 mils (0.0064 mm) to about 10 mils (0.26 mm); about 1 mil (0.026 mm) to about 7.5 mils (0.19 mm); even about 2 mils (0.051 mm) to about 5 mils (0.13 mm). Here as elsewhere in the specification and claims, numerical values can be combined to form new and non-disclosed ranges.

The adhesive label (facestock and adhesive layer(s)) can have a stiffness as desired for a particular purpose or intended application. Stiffness can be evaluated in any suitable manner now known or later discovered. The label stiffness can be given in terms of its ISO (International Organization for Standardization) 2493 bending resistance (at 15°) which is expressed in milliNewtons (mN). Bending can be evaluated using a L & W bending tester. In one embodiment, the adhesive label has a stiffness of from about 2 mN to about 20 mN; from about 5 mN to about 17 mN; from about 7 mN to about 15 mN; even from about 10 mN to about 12 mN. In one embodiment, the adhesive labels can have a stiffness of less than about 10 mN; less than about 8 mN; less than about 6 mN; even less than about 5 mN. In another embodiment, the adhesive labels can have a stiffness of from about 2 mN to about 10 mN; from about 4 mN to about 8 mN; even from about 5 mN to about 7 mN. Here as elsewhere in the specification and claims, numerical values can be combined to form new and non-disclosed ranges. The present dispensing apparatus and methods of using the same allow for the effective dispensing of labels having a relatively low stiffness (e.g., below 10 mN) without the issues or problems associated with conventional peel-plate methods.

The label stock includes a release liner. Release liners for use in the present invention may be those known in the art. In general, useful release liners include polyethylene coated papers with a commercial silicone release coating, polyethylene coated polyethylene terephthalate films with a commercial silicone release coating, or cast polypropylene films that can be embossed with a pattern or patterns while making such films, and thereafter coated with a commercial silicone release coating. A particularly suitable release liner is kraft paper which has a coating of low density polyethylene on the front side with a silicone release coating and a coating of high density polyethylene on the back side. Other release liners known in the art are also suitable as long as they are selected for their release characteristics relative to the pressure sensitive adhesive chosen for use in the present invention. In one embodiment of the invention, the release liner has a moldable layer of polymer under the release coating. The moldable layer may be, for example, a polyolefin such as, but not limited to, polyethylene or polypropylene. The surface of the release layer of the release liner may have a textured finish, a smooth finish, or a patterned finish. The release layer may have a randomly microstructured surface such as a matte finish, or have a pattern of three-dimensional microstructures. The microstructures may have a cross-section which is made up of circles, ovals, diamonds, squares, rectangles, triangles, polygons, lines or irregular shapes, when the cross-section is taken parallel to the surface of the release surface.

In one embodiment, the release liner has a release coating on both sides; one side having a release coating of a higher release value than the release coating of the other side. The label stock can comprise a heavy weight liner or a thin, light weight liner. The thickness of the thin liner is less than the standard 2.5 mils (0.064 mm). The thickness of the liner can be less than 2.2 mils (0.060 mm), less than 2.0 mils (0.051 mm), less than 1.8 mils (0.042 mm), or less than 1.2 mils (0.030 mm).

In one embodiment, the liner is an ultrathin or ultra light liner having a thickness of less than 1.02 mil (0.0254 mm), less than 1 mil (0.0254 mm), less than 0.92 mil (0.0233 mm), less than 0.8 mil (0.0203 mm), less than 0.6 mil (0.017 mm), less than 0.50 mil (0.013 mm), or equal to or less than 0.25 mil (0.00626 mm) Such thin liners are commercially available as Hostaphan® polyester film (e.g., 0.5 mil, 0.0127 mm, Tradename 2SLK silicone coated film) sheeting from Mitsubishi Chemical Company. Another liner material is provided by Avery Dennison as a 1.02 mil (0.026 mm) polyester backing sheet with a 1.25 mil (0.032 mm) adhesive layer.

It will be appreciated that any other operations or procedures can be performed to ensure that the label is fully adhered to the target substrate and/or to ensure that there is no lifting, wrinkles, bubbles, etc. present. Such additional operations include, but are not limited to post-application compression or wipe down of the labels.

While the invention has been described in relation to various aspects and embodiments, it is appreciated that various modifications may become apparent to those skilled in the art upon reading the specification. The subject matter described herein is intended to cover such modifications as fall within the scope of the appended claims.

What is claimed is:

1. An apparatus for dispensing adhesive labels from a liner web onto a substrate comprising:

a feed roll for housing a roll of label material comprising a plurality of adhesive labels disposed on a release liner; the adhesive labels comprising a facestock having an upper surface and a lower surface, and an adhesive layer disposed adjacent the lower surface of the facestock and in contact with the release liner;

a separation member for removing the adhesive labels from the release liner;

a nip member disposed adjacent the separation member; and a take-up roll for winding the release liner;

wherein the label material is oriented such that the upper surface of the facestock contacts the separation member as the label material is fed through the apparatus, and the separation member has a tackified surface providing a tack force between the upper surface of the facestock and the surface of the separation member that is greater than the release force between the adhesive layer and the release liner, and the tackified surface promotes separation of the adhesive labels from the release liner as the upper surface of the facestock contacts the separation member; and wherein the tackified surface comprises a polysilylene.

2. The apparatus of claim 1, wherein the separation member has a textured surface.

3. The apparatus of claim 1, wherein the adhesive labels have a stiffness of from about 2 mN to about 20 mN.

4. The apparatus of claim 1, wherein the adhesive labels have a stiffness of from about 2 mN to about 10 mN.

5. The apparatus of claim 1, wherein the adhesive labels have a stiffness of from about 5 mN to about 7 mN.

6. The apparatus of claim 1, wherein the adhesive labels have a stiffness of about 10 mN or less.

7. The apparatus of claim 1, wherein at least one of the feed roll, the separation member, the nip member, or the take-up roll is mechanically driven.

8. The apparatus of claim 7, comprising a conveyor system for moving the substrate into a position adjacent the separation roller such that a surface of the substrate contacts a leading edge of the adhesive surface of the adhesive label, wherein the tack force between the adhesive layer and the surface of the substrate is greater than the tack force between the upper surface of the facestock and the separation member, and the label detaches from the separation member and is applied to the surface of the substrate.

9. The apparatus of claim 8, wherein both the substrate and the separation member rotate as the label is applied to the substrate.

10. The apparatus of claim 1, wherein the apparatus is a manual device.

11. The apparatus of claim 10, wherein the apparatus is operated by:

positioning the apparatus such that the separation member is contacted with a target substrate onto which a label is to be applied;

moving the apparatus in a direction such that:

the label material is fed toward the separation member;

a leading edge of the upper surface of an adhesive label contacts the surface of the separation member such that the adhesive label detaches from the release liner and becomes associated with the separation member; and a leading edge of the adhesive surface of the adhesive label associated with the separation member contacts a surface of a target substrate; and the adhesive label detaches from the separation member and is applied to the surface of the target substrate.

12. A method of applying a pressure sensitive adhesive label to a surface of a substrate comprising:

providing a continuous roll of label material comprising a plurality of adhesive labels releasable attached to a release liner web, the adhesive labels comprising a facestock having an upper surface and a lower surface, and an adhesive layer disposed adjacent the lower surface of the facestock and in contact with the release liner;

feeding the label material through a labeling apparatus such that the upper surface of the facestock engages a separation member, where the separation member has a tackified surface providing a tack force between the surface of the separation member and the facestock that is greater than the release force between the release liner and the adhesive layer, and the adhesive label detaches from the release liner and associates with the separation member; and contacting a surface of a substrate with a leading edge of the adhesive layer of the adhesive label associated with the separation member, where the tack force between the adhesive layer and the substrate is greater than the tack force between the upper surface of the facestock and the surface of the separation member, and the adhesive label detaches from the separation member and is applied to the surface of the substrate, wherein the separation member comprises a roller, wherein the tackified surface comprises a polysilylene.

* * * * *